United States Patent [19]

Hawes

[11] Patent Number: 4,508,365

[45] Date of Patent: Apr. 2, 1985

[54] CONTINUOUS FORM PAPER WITH PULL TABS FOR EASIER SEPARATION

[75] Inventor: Debra K. Hawes, Cedar Rapids, Iowa

[73] Assignee: Rockwell International Corporation, El Segundo, Calif.

[21] Appl. No.: 477,582

[22] Filed: Mar. 21, 1983

[51] Int. Cl.[3] ..... B42D 15/00; B41L 1/20; B65D 27/10

[52] U.S. Cl. ..... 281/2; 281/5; 282/2; 282/5; 283/61; 283/62; 229/69

[58] Field of Search ..... 282/11.5 A, 11.5 R; 283/62, 61; 281/2, 8; 229/69

[56] References Cited

U.S. PATENT DOCUMENTS

| | | | |
|---|---|---|---|
| 1,681,168 | 8/1928 | Bovier | 282/11.5 A |
| 2,257,765 | 10/1941 | Sherman | 282/11.5 A |
| 3,325,188 | 6/1967 | Hiersteiner | 282/11.5 A |
| 3,339,827 | 9/1967 | Steidinger | 282/11.5 A |
| 3,554,438 | 1/1971 | Van Malderghem | 282/11.5 A |
| 3,837,565 | 9/1974 | Johnson | 282/11.5 A |
| 4,051,995 | 10/1977 | Wieman | 282/11.5 A |

*Primary Examiner*—Paul A. Bell
*Assistant Examiner*—Paul M. Heyrana, Sr.
*Attorney, Agent, or Firm*—Richard K. Robinson; George A. Montanye; H. Fredrick Hamann

[57] ABSTRACT

A continuous form paper has a plurality of sheets which are bifolded along perforated fold lines. At the top of each sheet and at the bottom of each sheet and in parallel with the fold lines are perforated tear lines. These tear lines create a pull tab when the sheets are bifolded into a stack. The pull tabs facilitate the separation of a relatively large stack of sheets into individual sheets by tearing along the perforated bottom tear line of a preceding sheet which is in parallel alignment with the top tear line of a following sheet.

7 Claims, 4 Drawing Figures

45

CONTINUOUS FORM PAPER WITH PULL TABS FOR EASIER SEPARATION

BACKGROUND OF THE INVENTION

The invention relates to continuous form paper and, in particular, to continuous form paper adapted for handling by an automatic printer with a paper handler.

Continuous form paper used by automatic printers with a paper handler is divided into individual sheets which are separated by a perforated fold line between adjoining sheets. The sheets are bifolded along the perforated fold lines and stacked to facilitate easy handling by the automatic printer. The separation of the sheets after printing is difficult and requires either a special machine to separate the pages along the perforated fold lines or each sheet is individually separated from the stack of printed sheets by hand. Both cases are objectionable because either an excessive amount of time is used when the separation is performed by hand or an expensive machine is required to perform the separation.

SUMMARY OF THE INVENTION

A continuous form paper has a plurality of sheets which are bifolded along perforated fold lines. At the top of each sheet and at the bottom of each sheet and in parallel with the fold lines are perforated tear lines. These tear lines create a pull tab when the sheets are bifolded into a stack. The pull tabs facilitate the separation of a relatively large stack of sheets into individual sheets by tearing along the perforated bottom tear line of a preceding sheet which is in parallel alignment with the top tear line of a following sheet.

It is the object of the invention to provide a continuous form paper of a plurality of sheets that are bifolded and can be easily separated into individual sheets.

It is yet another object of the invention to provide continuous form paper of bifolded sheets which may include a plurality of membranes separated from each other by a carbon film.

It is yet another object of the invention to provide continuous form paper having paper handling means to facilitate the rapid printing thereon.

BRIEF DESCRIPTION OF THE DRAWINGS

These and other objects and advantages of the invention may be ascertained from reading of the specification in combination with drawings in which.

DESCRIPTION OF A PREFERRED EMBODIMENT

Figure 1:
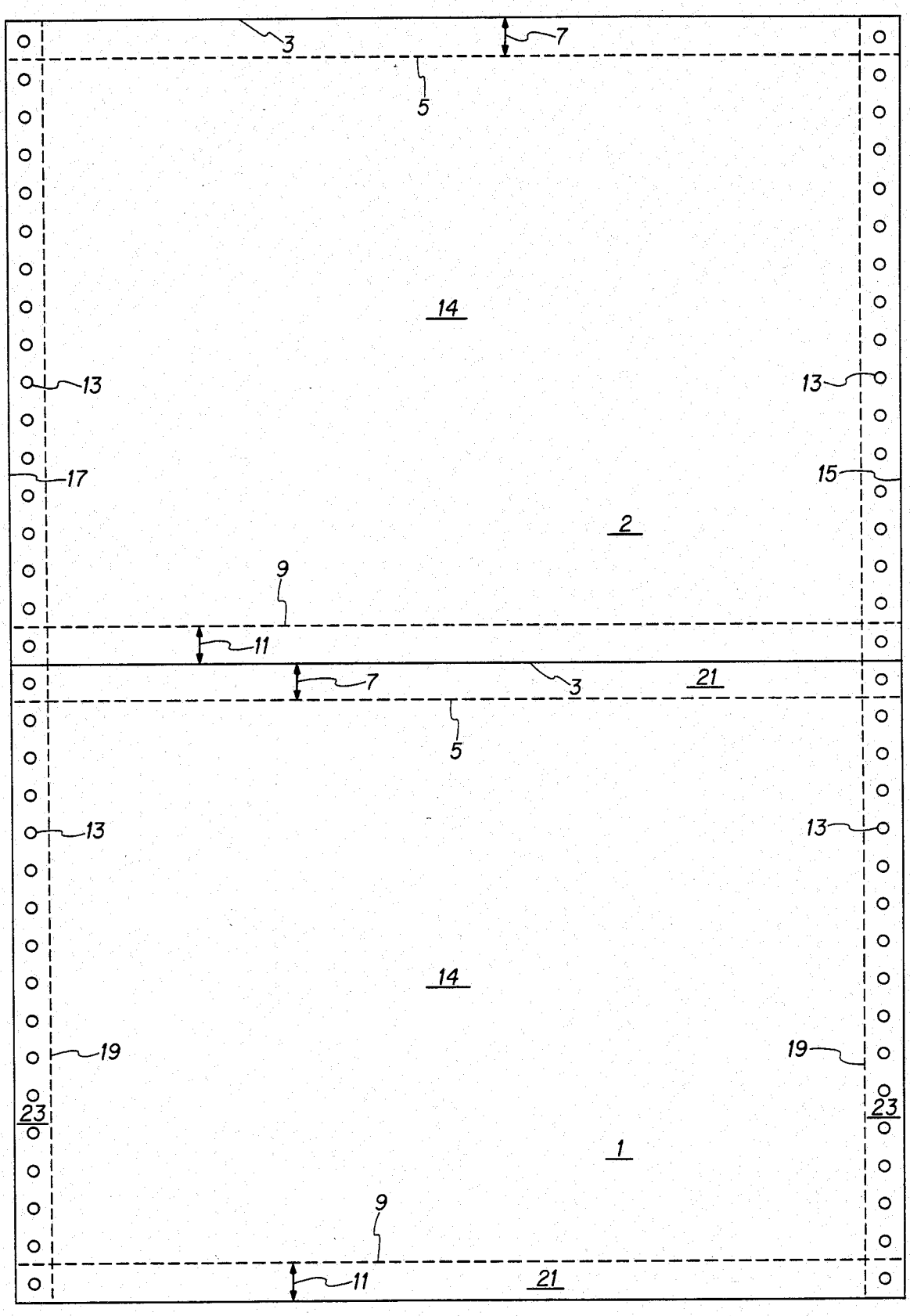
FIG. 1 is a layout of two sheets of the continuous form paper according to the invention.

In FIG. 1, to which reference should now be made, there is shown a plurality of sheets 14 that are part of a continuous form paper 45 and include a first sheet 1 and a second sheet 2. The sheets are normally stacked one on top of the other by folding along a fold line 3. At the top of each sheet is a top perforated line 5 which extends from edge 15 to edge 17 across the entire width of a sheet and that is separated from the fold line 3 by a first selected distance that is represented by the dimension line 7. This distance is selected to create pull tabs 21. The grasping of a stack of folded sheets at the pull tabs 21 and pulling will separate the individual sheets by tearing along a top perforated line 5 and a bottom perforated line 9. The bottom perforated line 9 extends from edge 15 to edge 17 across the entire width of a sheet and is separated from the fold line 3 by the preselected distance that is represented by the dimension line 11 which, in the preferred embodiment, is the same length as the dimension line 7. When the second sheet 2 is folded on top of the first sheet 1, as occurs when the paper is bifolded, the bottom perforation line 9 is in alignment with the top perforated line 5 creating the pull tabs 21 thereby and consequently, by one pull on the pull tab 21, the bottom of the sheet 2 is separated from the top of the sheet 1.

Because mechanical paper handling equipment often is driven by sprocket mechanisms, there are tractor sprocket holes 13 provided in parallel alignment with a right hand edge 15 and a left hand edge 17 of the bottom sheet 1 and the top sheet 2. There is a second perforation line 19 that is in parallel with both the sprocket holes 13 and both the right hand edge 15 and the left hand edge 17. The perforation line 19 provides tear guides for the removal of the tractor sprocket holes 13 so that a clean sheet of paper of a preselected area is provided to the user.

Figure 2:
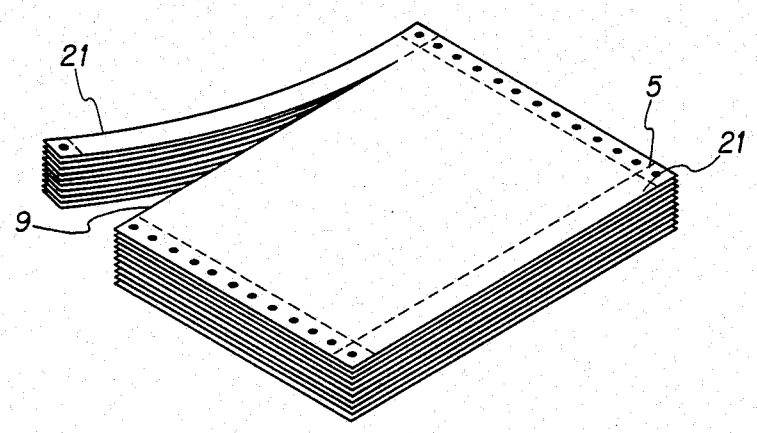
FIG. 2 is an illustration showing the separation of a plurality of sheets from one another.

FIG. 2 illustrates the separation of the pull tab 21, comprising material between the fold line perforated line 5 and the perforation line 9. It should be noted that, in the preferred embodiment, the fold line 3 is also a perforated line. The perforations that comprise the line weaken the paper and facilitate the easy folding thereof and a guide for tearing of the paper.

Figure 3:
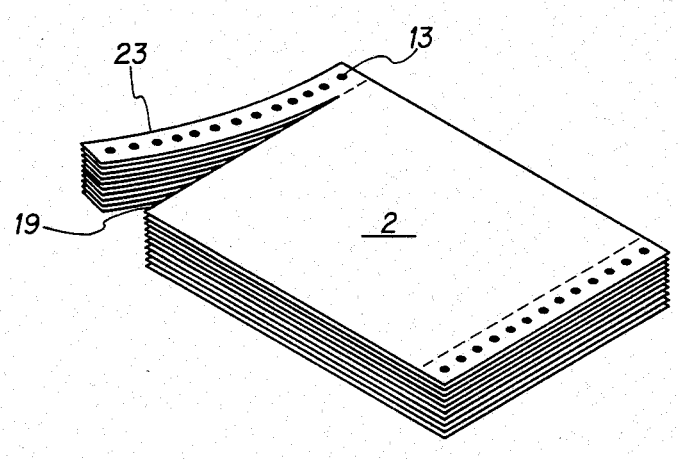
FIG. 3 is an illustration showing the separation of the sprocket holes from the continuous form.

FIG. 3 shows the separation of the excess material 23, which is the area between the left hand edge 17 and the perforated lines 19 in which the tractor sprocket holes 13 are located.

Figure 4:
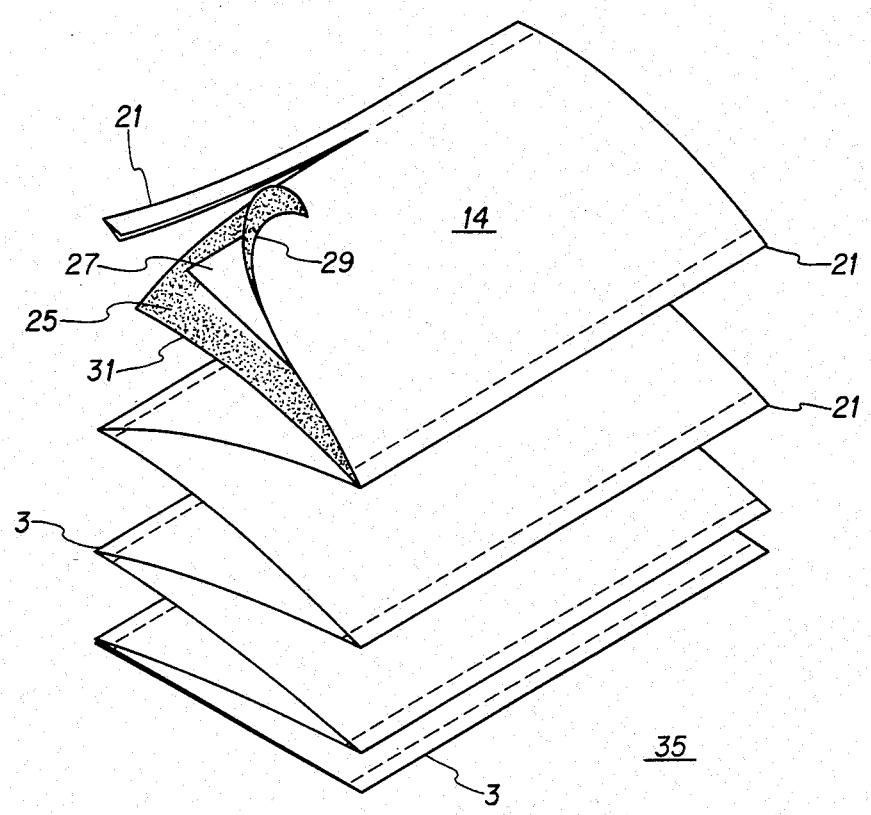
FIG. 4 is an alternate embodiment of the invention.

In FIG. 4, to which reference should now be made, there is shown a stack of continuous form paper 35 that is bifolded along the fold lines 3. Each sheet of paper 14 consists of a plurality of membranes although for simplicity the embodiment of FIG. 4 shows only a top membrane 29 and a bottom membrane 31. Separating the top membrane 29 from the bottom membrane 31 is a carbon film 27 which facilitates the printing of the bottom membrane 31 with the information that is applied to the top membrane 29 when passed through a printing mechanism. These multiple copy forms are used where it is necessary for several parties to keep copies of the same information, such as a W-2 form which is used to indicate the earnings and tax information for the worker as well as the tax collector. The top membrane 29 is attached to the bottom membrane 31 by a restraining material 25. This may be accomplished by a thin glue area or a pressurized area where, under vapor and pressure, the top membrane is secured to the bottom membrane 29 until it is separated by the user. Alternatively, perforations may be used to separate the top membrane from the bottom membrane.

Many changes and modifications in the above described invention can, of course, be carried out without departing from the scope thereof. Accordingly, the invention is intended to be limited only by the scope of the appended claims.

I claim:

1. A material construction which facilitates continuous form feed comprising:

a plurality of rectangular sheets of material, each sheet being idencal in configuration to the other sheets and having top and bottom edges extending parallel to one another and first and second side edges extending between said top and bottom edges and parallel to one another, said sheets being coupled to one another along a fold line defined between an interconnection of said bottom edge of one sheet with the top edge of the next successive sheet of said plurality of sheets, said sheets folding at said fold line to enable stacking of said sheets one upon the other to form a bundle having the same rectangular configuration as a sheet;

a top tear line extending parallel to the top edge of each sheet between the first and second side edges of a sheet across the entire width of each sheet, said first tear line being spaced from said top edge by a predetermined distance; and a bottom tear line extending parallel to the bottom edge of each sheet between the first and second side edges of a sheet across the entire width of each sheet, said second tear line being spaced from said bottom edge by a predetermined distance, said predetermined distance between the bottom tear line and the bottom edge of one sheet being equal to said predetermined distance between the top tear line and the top edge of the next succeeding sheet such that when said sheets are folded to form a stack, the sheets forming said stack may be separated by tearing along a single line adjacent said top edges and a single line adjacent said bottom edges of said sheets formed by the stacked alignment of the bottom tear line of one sheet with the top tear line of the next successive sheet.

2. The material construction of claim 1 wherein each sheet further comprises a first side tear line extending parallel to the first side edge between the top and bottom edges and spaced from said first side edge by a predetermined distance, and a second side tear line extending parallel to said second side edge between the top and bottom edges and spaced from said second side edge by a predetermined distance, said first side tear line of each sheet being spaced the same predetermined distance from said first side edge and said second side tear line of each sheet being spaced the same predetermined distance from said second side edge such that when said sheets are folded to form said stack, all sheets may be torn simultaneously along a single line defined by said first side tear lines and all sheets may be torn simultaneously along a single line defined by said second side tear lines.

3. The material construction of claim 2 wherein each sheet includes a plurality of spaced holes in the portion of the sheet between said first side edge and first side tear line, and in the portion of the sheet between said second side edge and said second side tear line, said holes extending in spaced relation between the top and bottom edges of each sheet.

4. The material construction of claim 1 wherein said fold line is formed as a perforated line.

5. The material construction of claim 1 wherein said tear lines are perforated lines.

6. The material construction of claim 1 wherein each sheet comprises a plurality of parallel membranes and a carbon film separating each membrane from the next successive membrane, said membranes being attached to one another to define each sheet.

7. A method for forming and separating a stack of a plurality of sheets of material wherein each of said sheets have a generally rectangular configuration having parallel top and bottom edges and parallel first and second side edges extending between said top and bottom edges and said bottom edge of each sheet being coupled to the top edge of the next successive sheet along a fold line such that the sheets may be stacked one upon the other by folding at each fold line to form a stack having the rectangular configuration of a sheet and defining a continuous form material, the improvement in the method of separating the sheets at the top and bottom edges comprising:

forming a top tear line parallel to said top edge of each sheet and extending across the entire width of a sheet between said first and second side edges, said top tear line being spaced from said top edge by a predetermined distance;

forming a bottom tear line parallel to said bottom edge of each sheet and extending across the entire width of a sheet between said first and second side edges, said bottom tear line being spaced from said bottom edge by a predetermined distance, said bottom tear line of one sheet being spaced from its bottom edge by the same predetermined distance that the top tear line of the next succeeding sheet is spaced from its top edge; and tearing said sheet simultaneously along a single line adjacent said top edges and a single line adjacent said bottom edges of said stacked sheets wherein said single lines are formed by the stacked alignment of the bottom tear line of one sheet with the top tear line of the next successive sheet.

* * * * *